United States Patent [19]

Garschick

[11] 4,449,013

[45] May 15, 1984

[54] OIL WELL CABLE

[75] Inventor: Alfred Garschick, Raynham, Mass.

[73] Assignee: BIW Cable Systems, Inc., Boston, Mass.

[21] Appl. No.: 352,797

[22] Filed: Feb. 26, 1982

[51] Int. Cl.[3] ..... H01B 7/22

[52] U.S. Cl. ..... 174/103; 174/106 R; 174/106 SC; 174/109

[58] Field of Search ..... 174/102 SC, 105 SC, 174/106 SC, 106 R, 108, 109, 103

[56] References Cited

U.S. PATENT DOCUMENTS

| | | | |
|---|---|---|---|
| 451,605 | 5/1891 | Andrews | 174/106 R |
| 2,145,092 | 1/1939 | Mitchell | 174/103 |
| 2,234,068 | 3/1941 | Wiseman | 174/103 |
| 2,623,093 | 12/1952 | Smith | 174/106 R |
| 2,754,352 | 7/1956 | Connell | 174/108 |
| 3,183,300 | 5/1965 | Jachimowicz et al. | 174/106 R |
| 3,588,317 | 6/1971 | Hutchins | 174/106 R X |
| 3,943,271 | 3/1976 | Bahder et al. | 174/105 SC X |
| 4,282,398 | 8/1981 | Solomon | 174/106 R |

FOREIGN PATENT DOCUMENTS

| | | | |
|---|---|---|---|
| 216883 | 8/1958 | Australia | 174/106 R |
| 932134 | 8/1973 | Canada | 174/106 R |
| 849943 | 9/1960 | United Kingdom | 174/106 R |
| 2032678A | 5/1980 | United Kingdom . | |

*Primary Examiner*—A. C. Prescott
*Assistant Examiner*—Morris H. Nimmo
*Attorney, Agent, or Firm*—Kenway & Jenney

[57] ABSTRACT

An electrical cable for use in oil wells and other hostile environments. The cable includes one or more solid or stranded conductive elements, each of which is covered first by an insulating layer of high-temperature insulation. The insulating layer is covered by a metallic barrier composed of tape or film which may be coated with bonding material. Over the metallic barrier a semiconductive layer is formed, and that in turn may be encased in an armor sheath, the semiconductive layer providing cushioning as well as an electrical connection between the metallic barrier and the armor sheath.

7 Claims, 3 Drawing Figures

OIL WELL CABLE

BACKGROUND OF THE INVENTION

There are few more hostile environments for electrical cable than an oil well. Yet, it is frequently necessary to utilize down-hole cables in oil wells for such equipment as submersible pumps, well-logging and various other functions.

Among the potentially destructive elements which these cables are subjected to are gas and hydrostatic pressures which may exceed 5000 psi in wells of depths of the order of 10,000 feet. These pressures cause gas and fluids to permeate the cable insulation, and cables which are removed from such wells frequently exhibit embolisms and ruptures which cause cable failure.

When cables are exposed to such fluid permeation for long periods, electrical degradation of the insulation results. One expedient which has been used to partially alleviate this condition is a low permeability insulation. Such insulation allows the gases collected in the cable to be vented when the cable is removed from the high pressure environment of the oil well.

Another technique for preventing the ingress of gas and moisture is to cover the cables with material such as lead. However, such coverings are rather easily embrittled or otherwise damaged by flexing and handling. Some success has been achieved by utilizing a low-swell type of oil-resisting nitrile rubber compound combined with a metal cladding. Even if openings develop in the metal cladding, the combination remains somewhat effective.

In addition to gas permeation problems, the fluids found in wells and in the drilling materials which are used are frequently corrosive or abrasive to a high degree. Various materials have been adopted to prevent the ingress of fluids in oil well cables, and they range from conventional armoring techniques to internal pressurization to resist such inflow of destructive fluids from the well. One technique is to wrap metal of plastic tape over the layer of insulation which in turn encloses the active conductor. The metal tape is then usually covered with an insulating material which in turn is protected by a jacket of armor. Despite the use of such complex and relatively expensive structures, chemical and electrolytic corrosion of the metallic members frequently occurs, especially when cable is left in a well for prolonged periods. This corrosion usually begins at the outer layer, but soon works its way through the metal to cause breakdown of the cable.

It is a primary object of the present invention to improve oil well cable.

It is another object of the present invention to increase the resistance to gas permeation of electrical cable.

It is another object of the present invention to increase the resistance to moisture permeation of electrical cable.

It is another object of the present invention to increase the resistance of electrical cable to chemical and electrolytic corrosion.

It is a further object of the present invention to lengthen the life and improve the performance of down-hole cable.

SUMMARY OF THE INVENTION

In the present invention, a typical oil well cable includes a plurality of basic conductors, usually of solid or stranded copper, each of which is encased in a jacket of high-temperature insulation over which a metal barrier is formed. The barrier may consist of tape coated with bonding material and helically wound over the insulation. A single layer of tape wound helically and overlapping itself by ⅔ or more of its width may be used. Alternatively, two such tapes wound helically in the same or opposite directions and each overlapping itself by a factor of 50% or more may be used. In certain applications, more than two tapes may be employed. The tapes are relatively thin and the coating of bonding material is applied to one or both sides of the tapes.

Alternatively, thin metal films coated with bonding material are wrapped longitudinally in an overlapping configuration over the insulation. Depending upon the particular bonding material used, the tape or film may be heated to a temperature of 300° F. or more to fuse the layers into a composite multi-layer.

Over the metal barrier thus formed, a semiconductive synthetic rubber compound is extruded. The three conductors, each treated in the manner described, are assembled in either a round or flat configuration which is then covered by an outer armor sheath. The semiconductive material on the individual conductors not only serves as a cushion against the outer sheath of armor but also serves to electrically connect the metal foil barrier to the armor. The continuous electric contact provided by the semiconductive compound along the length of the cable serves to prevent the concentration of localized leakage currents which could cause electrolytic corrosion and cable deterioration at a single point.

For a better understanding of the present invention, together with other and further objects, features, and advantages, reference should be made to the following description which should be read in connection with the appended drawing in which.

DESCRIPTION OF PREFERRED EMBODIMENTS

Figure 1:
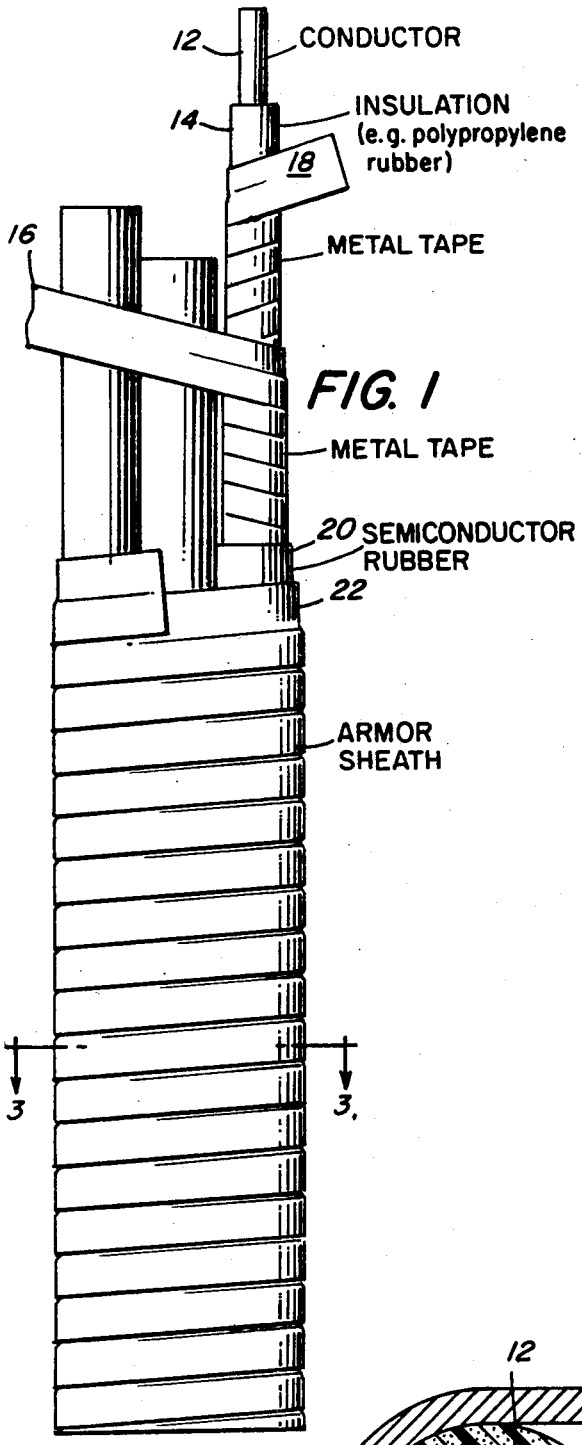
FIG. 1 illustrates a flat pump cable for use in an oil well.
Figure 3:
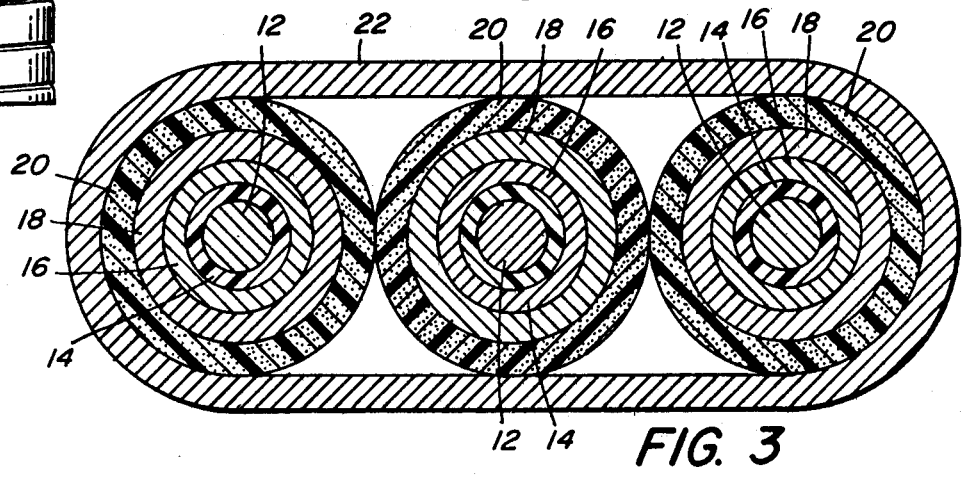
FIG. 3 is a cross-section of FIG. 1 taken along the line 3—3.

In FIGS. 1 and 3 of the drawing, a typical three-conductor down-hole cable is shown. The three conductors may be identical, and each includes a central conducting element 12 which may be of solid or stranded copper. The conducting element 12 is typically designed to handle three kilovolts AC and the AWG wire size should be 4 or more.

Although a flat cable is illustrated, as is explained in greater detail below, the capacitance unbalance usually associated with conventional flat cable is avoided in the practice of the present invention. The capacitance of the illustrated cable is substantially the same as that which would be had with a round three-conductor cable.

Over a typical conducting element such as that shown at 12, a layer 14 of high-temperature insulation which may be polypropylene, ethylene propylene, rubber, or other suitable insulation, is extruded or otherwise applied. The insulating layer 14 may be 0.045" to 0.072" in thickness. As previously noted, one or more tapes or films may be used to create a suitable metallic barrier. The preferred structure which is shown includes a pair of tapes of aluminum, stainless steel, or other suitable metal 16 and 18 about 0.004" thick coated with a bonding material on one or, preferably, both sides. The bonding material may be a polymer adhesive approximately 0.001" thick. The tapes are wound helically over the insulating layer 14, each lapping itself by a factor of 50% or more. The multi-layer metal barrier formed by the tapes is covered with a layer of semiconductor synthetic rubber compound 20 such as nitrile rubber. Other conventional semiconductive materials could be used, but nitrile rubber is preferred for its oil-resisting qualities. Finally, an armor sheath 22 is wound over the three insulated conductors which are in parallel planar relationship to provide a flat configuration in this instance. The sheath may be galvanized steel wrapped profile tape approximately 0.020" thick. In some instances, the armor may be composed of phosphor bronze, stainless steel, or other suitable material.

The semiconductive rubber layer 20 serves two purposes. First, of course, it provides cushioning between the steel armor and the metal barrier. Second, by reason of its semiconductive nature, it provides continuous electrical contact between the steel armor and the metal barrier along the full length of the cable. Because of the continuous electrical contact, localized leakage currents are avoided and accordingly electrolytic corrosion at such localized points is avoided. Such corrosion is a common cause of failure of electrical cable.

Reference has been made to the avoidance of capacitance unbalance in flat cables built in accordance with the present invention. The geometry of a conventional flat cable causes the flat cable to exhibit capacitance unbalance because the capacitance between each of the outer conductors and ground is different from the capacitance of the center conductor to ground. With the metallic barrier structure of the present invention, on the other hand, the capacitance is substantially the same between each conductor and ground because of the connection between each of the barriers to the armor sheath by means of the semiconductive rubber layer. Thus, the same balanced characteristics available in round cable are made available in flat cable, which is of importance where, as frequently is the case, space to accommodate cables in the oil well is at premium.

Chemical corrosion, which is also a prevalent problem in oil well cable, is inhibited by the utilization of alternate layers of metal and polymer.

Figure 2:
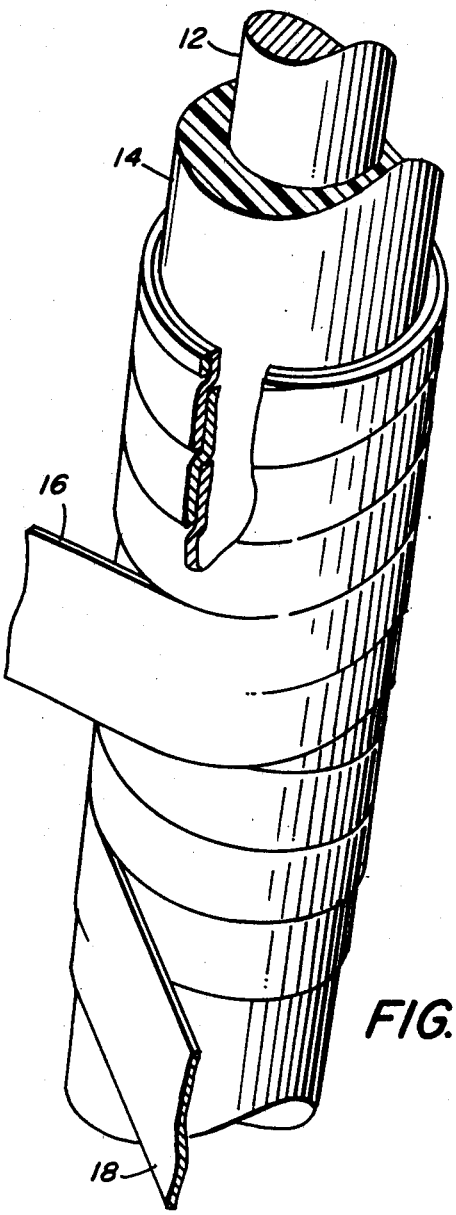
FIG. 2 is an enlargement of a portion of FIG. 1.

In FIG. 2, the manner of winding of the tapes 16 and 18 is shown in greater detail. The two tapes are wound helically in opposite directions over the insulation 14 and each tape overlaps itself by a factor of 50%. The bonding material may be any of several available polymer adhesives and as the tapes or films are incorporated in the cable, the cable is heated to a temperature sufficiently high to cause the bonding material to fuse the tapes or films into a single metallic composite barrier. Although the presently preferred thickness of the metal tape or film is approximately 0.004", superior performance of the cable has been achieved with metals such as aluminum and stainless steel of thickness ranging from 0.001" to 0.008".

Alternatively, in place of the helically wound metal tapes, continuous films of metal may be wrapped in overlapping fashion longitudinally over the insulating layer. These films would be of the same thickness as the tapes and would also have similar bonding layers of polymer adhesive on one or both their surfaces.

The vastly improved performance of cable made in this fashion has been demonstrated by testing. Standard cable made with similar insulation when tested at 3 kV AC has the following typical life in water at 90° C.: 376 hours 598 hours, 664 hours, 975 hours. The same cable when constructed with the metal barrier and bonding materials of the invention has voltage life at 90° C. in water in excess of 6000 hours. Although a three-conductor cable has been described and emphasized because of its obvious pertinence to three-phase power supplies, the invention is, of course, applicable broadly irrespective of the number of conductors involved in the oil well cable.

What is claimed is:

1. In an electrical cable for use in a hostile environment, the combination of a plurality of electrical conductors disposed in parallel relationship, each said conductor being surrounded by a relatively thick jacket of high-temperature, low-permeability insulating material, at least one relatively thin metallic barrier layer surrounding and bonded to each said jacket, a layer of semiconductive insulating material surrounding each said barrier layer and a conductive armor sheath surrounding and in electrical contact with each of said layers of semiconductive insulating material, said layers of semiconductive material cushioning said electrical conductors from said armor sheath and providing a conductive path between said metallic barrier layers and said armor sheath along the length of said cable.

2. In an electrical cable as defined in claim 1, the combination wherein said plurality of conductors are disposed in planar relationship.

3. In an electrical cable as defined in claim 1, the combination wherein said metallic barrier layer comprises two layers of metal fused together with bonding material.

4. In an electrical cable as defined in claim 3, the combination wherein said layers of metal comprise two lengths of tape wound helically in opposite directions about said low-permeability insulation.

5. In an electrical cable as defined in claim 3, the combination wherein said layers of metal comprise a plurality of continuous lengths of film wrapped longitudinally in overlapping relationship about said low-permeability insulation.

6. In an electrical cable as defined in claim 3, the combination wherein said bonding material is composed of a polymer.

7. In an electrical cable as defined in claim 4, the combination wherein each said length of tape is approximately from 0.001" to 0.008" in thickness and said bonding material is approximately 0.001" in thickness.

* * * * *

UNITED STATES PATENT AND TRADEMARK OFFICE

CERTIFICATE OF CORRECTION

PATENT NO. : 4,449,013

DATED : May 15, 1984

INVENTOR(S) : Alfred Garshick

It is certified that error appears in the above-identified patent and that said Letters Patent are hereby corrected as shown below:

On the front page of the patent, lines 2 and 4, the inventor's name should be spelled --Garshick--.

Signed and Sealed this

*Twenty-sixth* Day of *March 1985*

[SEAL]

*Attest:*

DONALD J. QUIGG

*Attesting Officer* *Acting Commissioner of Patents and Trademarks*